United States Patent [19]

Christophersen et al.

[11] 4,084,724

[45] Apr. 18, 1978

[54] MAP VENDING MACHINE

[75] Inventors: Clarence E. Christophersen, San Clemente; Currie Armstrong, Los Angeles, both of Calif.

[73] Assignee: Rockwell Enterprises, Inc., Carson, Calif.

[21] Appl. No.: 721,689

[22] Filed: Sep. 22, 1976

[51] Int. Cl.[2] ..... B65H 7/04

[52] U.S. Cl. ..... 221/20; 221/213; 221/251

[58] Field of Search ..... 221/213, 271, 276, 197, 221/287, 20, 268, 269, 270, 272–275, 152, 251

[56] References Cited

U.S. PATENT DOCUMENTS

| | | | |
|---|---|---|---|
| 520,769 | 6/1894 | Cochran | 221/152 |
| 3,412,895 | 11/1968 | Hilton | 221/268 |
| 3,872,997 | 3/1975 | Armstrong et al. | 221/213 |

*Primary Examiner*—Stanley H. Tollberg
*Attorney, Agent, or Firm*—Georges A. Maxwell

[57] ABSTRACT

A vending machine for flat, folded paper maps comprising, a box-like housing with a horizontal interior plate, elongate vertical open-ended chutes with front, side and rear walls, slidably receiving vertical stacks of flat multi-panel folded paper maps and arranged in the housing above the plate, structure yieldingly connecting the rear walls to the plate, members yieldingly urging the upper ends of the chutes rearwardly to incline the chutes rearwardly to vary the vertical space between the plate and lower edge of the front walls of the chutes, discharge slots in the housing spaced forward of the lower ends of the chutes, U-shaped ejector slides with flat bases slidably engaged on the plate beneath the bottoms of the chutes and vertical side flanges slidably engaging the exterior of the side walls of the chutes, gripping elements on the slides to grip arched portions of the lowermost maps upon forward shifting of the slides to urge the maps forwardly beneath the lower edges of the front walls of the chutes and thence through the slots, said lower edges of the front walls having straight, horizontal center portions cooperating with the plate to accommodate the flat, central portions of the folded maps and having laterally outwardly and upwardly inclined end portions cooperating with the plate to accommodae thicker, resilient side portions of the folded maps.

12 Claims, 8 Drawing Figures

MAP VENDING MACHINE

This invention has to do with an improved vending machine for dispensing multi-panel folded paper road maps and the like.

The machine here provided is similar to but incorporates novel improvements which distinguish it from that map vending machine which is disclosed in U.S. Pat. No. 3,872,997 for "MAP VENDING MACHINE", issued Mar. 25, 1976 to Clarence E. Christophersen and Currie Armstrong.

While the following disclosure will restrict use of the instant machine for the dispensing of road maps, it is to be understood and will be apparent that the machine is such that it can be satisfactorily employed to vend and dispense many other flat, stackable, vendable items.

For many years it has been common practice for oil companies to provide free road maps for their customers. Such road maps are made available and distributed through and by the retail outlets or service stations of the companies. Such maps cover a limited area and, as a general rule, are limited to one county or some larger and appropriate geographical area where land development has not advanced to any great extent and population density is low.

The general plan or scheme of distributing and dispensing of such road maps has been as follows: Each service station maintains a supply of maps of the county or that limited and defined geographical area in which it is situated and maintains a supply of maps of the adjoining or adjacent counties or areas, whereby the customer or traveler can be provided with an appropriate map of the immediate area and a map of the next or adjacent area into which his travels will take him. As a general rule, the ordinary service station need only maintain a supply of three different maps in accordance with the above scheme of distribution to supply the needs of the overwhelming majority of its customers. In those situations where three maps are not sufficient to meet demands, a supply of six maps is generally more than adequate.

In recent years, the cost of road maps has increased substantially and the demand for such maps has also increased at a substantial rate. Further, as a result of the tendency of some of the public to indiscriminately and wastefully take readily available free road maps at service stations, many service stations have discontinued providing such maps while others keep a limited supply, under lock and key, for selective distribution to their regular customers and the like.

It has been found that the practice of service stations selling maps which are considered by the general public to be free is an extremely poor practice and carries much ill-will. It is far better practice to simply not have maps available than to sell them in a hand to hand bargain and exchange.

As a result of the above, there is an ever-increasing use of coin operated road map vending machines located at service stations to make road maps available to the motoring public in a manner in which service station personnel need not be burdened or directly confronted with the task of distributing, stocking and selling such maps.

The ordinary road maps of the character referred to above and here concerned with is on a single large sheet of paper which, as a general rule, measures approximately 2 feet by 3 feet. When such maps are folded, they ordinarily measure about 4 inches by 9 inches and establish or define from 25 to 35 layers or panels. The exposed surfaces of the upper and lowermost layers or panels of such maps are those panels upon which advertising and other appropriate data and information, not considered part of the map per se, is printed and displayed.

The ordinary road map, when folded, as above noted, is so folded and arranged that it has a straight, clean, uninterrupted or unbroken leading edge extending across one of its ends (normal to the major dimension or longitudinal axis of the map) and, established by a fold at and between the adjacent ends of the above noted outer exposed surfaces or advertising panels of the map.

While folded multi-panel road maps of the character here concerned with appear to be flat, when folded, the folded units are generally thicker and somewhat resilient along their edge portions than across their central portions. The thickened resilient edge condition of such maps is a result of the accumulative effect of the adjacent radial folds which occur at the edges of the folded unit.

Maps of the character referred to above are ordinarily and most satisfactorily packaged, stored and handled for distribution in vertical stacks and are such that they do not lend themselves to being satisfactorily dispensed, one at a time, by the product handling means commonly provided in conventional vending machines. The principal difficulty associated with conveying and dispensing means for products or maps such as here concerned with is the tendency for the paper (layers) to catch, fold, tear and otherwise be caught and mutilated by the mechanical means and devices brought into contact therewith and to foul and/or jam such devices.

The prior art has provided vending machines which can be adjusted and made serviceable to dispense road maps and the like, but as a general rule, such machines are quite complicated and costly to make, service and maintain and further require that the products handled and dispensed thereby be individually and carefully deposited in the machines in some special, inconvenient and time consuming manner.

An exception to the above is that vending machine disclosed in U.S. Pat. No. 3,872,997, noted above, which machine was conceived and designed especially for handling and dispensing road maps.

While the above noted patented machine has proven to be effective and has experienced notable commercial success, it has proven to be less effective than desired in several respects. First, it is more complicated and costly than is desired; second, it has shown a tendency to fail to properly engage and advance maps for dispensing; and third, it has shown a tendency to block and prevent the passage of maps, advanced for discharge, between the lower edges of the chutes and the plate.

The noted tendency of the above noted patented machine to fail to properly advance maps to be engaged has been determined to be a result of inadequate carrying support afforded by the advancing means and inadequacies in and over reliance upon the gripping means which form a part of the advancing means.

The noted tendency of the above noted patented machine to stop movement or passage of maps between the lower edges of the chute and the plate has been determined to be caused by the irregular enlarging or thickening of the side edges of the maps caused by the folded paper stock which join adjacent panel portions of the map along the edges of the folded map units.

It is an object and feature of the present invention to provide an improved machine for vending folded paper maps and the like, which machine is more simple, effective and dependable in operation and is more economical to make, service and maintain than machines of a similar nature provided by the prior art.

Another object and feature of the instant invention is to provide a machine of the character referred to which is adapted to receive supplies of stacked maps and which is effective to selectively remove and dispense maps, one at a time, from said stacks of maps.

Yet another object and feature of this invention is to provide a machine of the character referred to having a novel receiving means to hold and releasably retain a stack of maps and related novel advancing means to serve to releasably engage and advance a map at the bottom of the stack of maps in the receiving means and to dispense it from the machine.

It is another object of the present invention to provide novel locking means to releasably lock and to render the advancing means inoperable when the stack of maps related thereto is exhausted.

Finally, it is an object and feature of the present invention to provide a machine of the character referred to which includes novel structure affording the free movement of folded maps having thickened side edges, when those maps are transported forwardly beneath the lower front edges of the chutes.

The foregoing and other objects and features of the present invention will be apparent and fully understood from the following detailed description of a typical preferred form and carrying out of my invention throughout which description reference is made to the accompanying drawings, in which.

Figure 1:
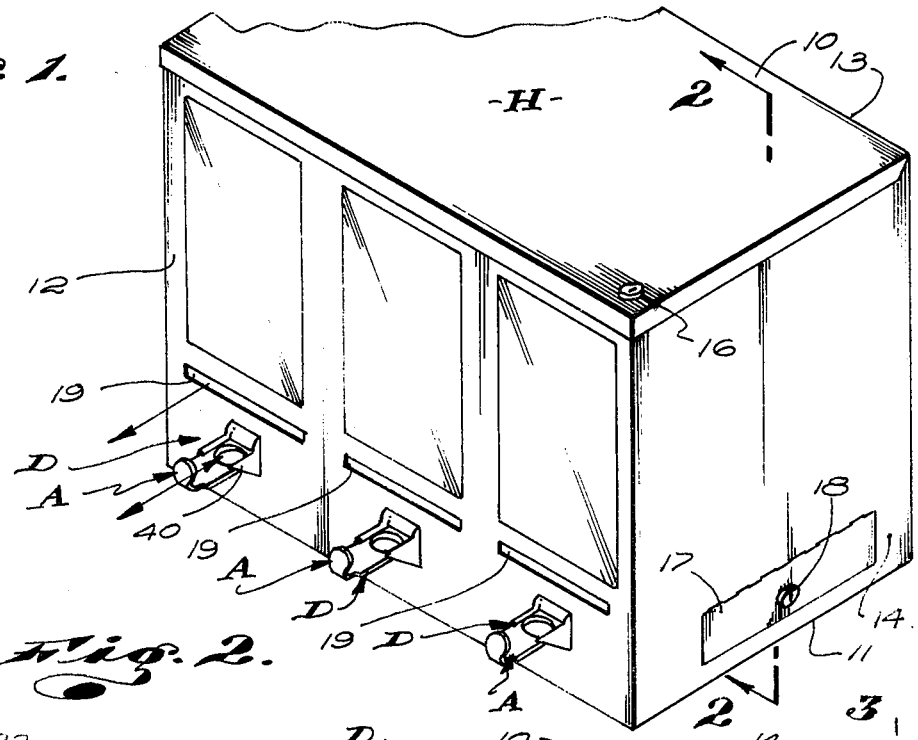
FIG. 1 is an isometric view of a machine embodying the instant invention.
Figure 2:
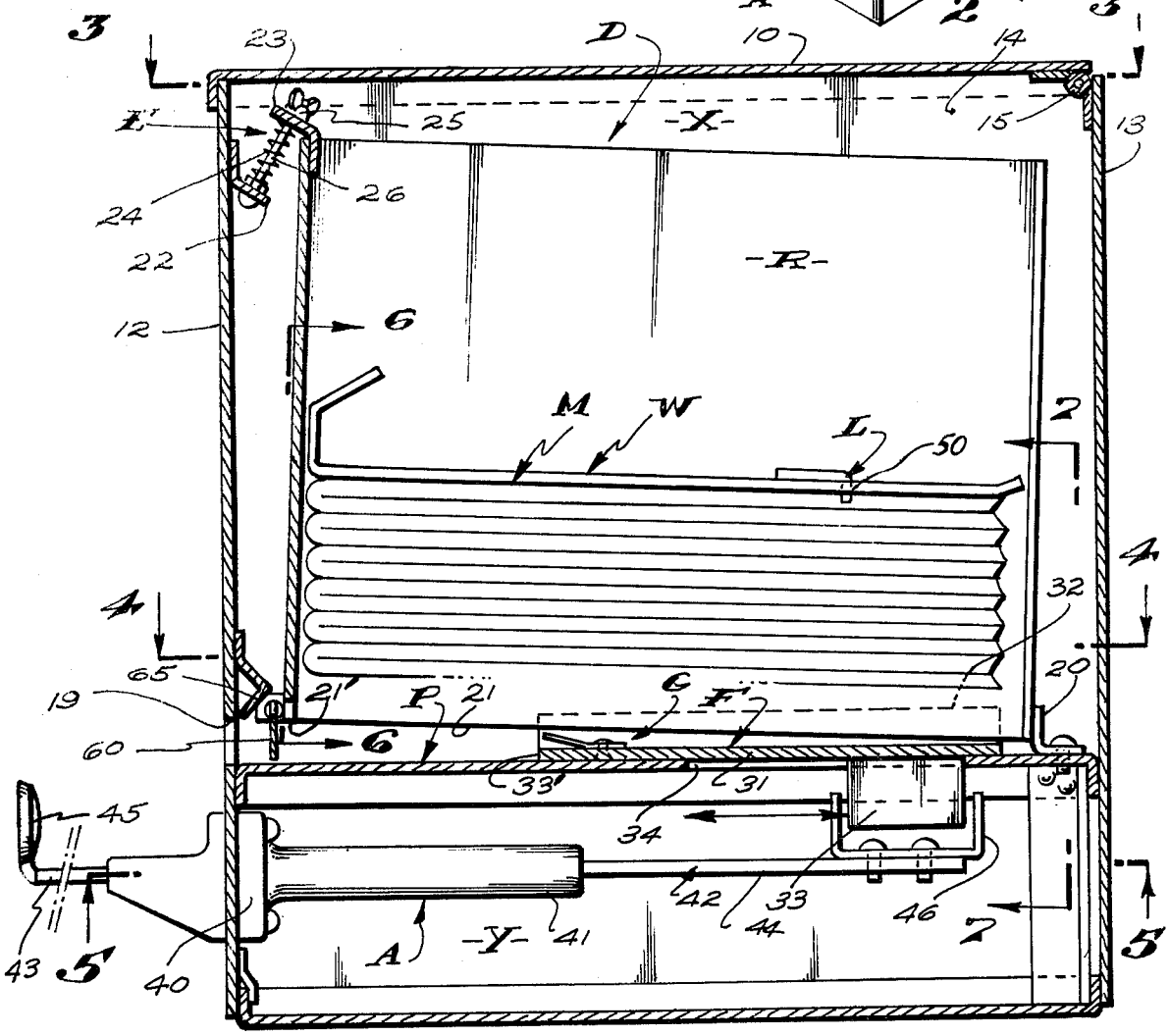
FIG. 2 is a sectional view taken substantially as indicated by line 2—2 on FIG. 1.

The map vending machine that we provide and which is illustrated in the accompanying drawings includes a boxlike case or housing H and a plurality of separate map dispensing means D within the housing. Each dispensing means D includes a coin-controlled actuating means A accessible at the exterior of the housing H. The means D further includes locking means L to lock the means A when the supply of maps related thereto is exhausted.

The housing H is a box-like structure with flat, top, bottom, front and side walls 10, 11, 12, 13 and 14, respectively. Within the housing and spaced between the upper and lower limits thereof is a horizontal partition-like plate P defining upper and lower chamber or compartments X and Y.

In practice, the front edge portion of the plate P is fixed to and supported by the front wall of the housing while the rear corners thereof are supported by vertical legs or columns, the lower ends of which are engaged with the bottom wall of the housing.

The top wall 10 is in the nature of a cover hinged to the rear wall 13 as at 15 and releasably locked at the front wall as by means of a suitable key-operated lock 16.

The hinged top wall 10 provides for easy and convenient access into the chamber X.

In addition to the foregoing, the housing H can, as shown, be provided with a hinged access door 17 under control of a key lock 18, in one side wall of the housing H and to provide access to the lower chamber Y.

The shape and details of construction of the housing can be varied widely without affecting the novelty and spirit of the instant invention.

The dispensing means D that I provide are arranged in the upper chamber X. Each means D is adapted to receive and to hold a stack of maps M. Each means D is operable to dispense its related maps, one at a time, through a related slot-like discharge opening 19 in the front wall 12 of the housing H. In the case illustrated, the machine is provided with three dispensing means D.

Each dispensing means D is a separate or independent means and includes an elongate, vertical map-receiving chute R with open upper and lower ends and corresponds generally, but is slightly greater in horizontal cross-section than the plane configuration of the folded maps M related thereto, whereby the maps can be freely received or accommodated by the chute, as clearly illustrated in the drawings.

In practice, and as shown in the drawings, the rear wall of the chute of each means D can be provided with a central vertical slot-like opening to facilitate manufacture of the chutes and to provide access to the maps within the chute and to facilitate their removal from the chute, if circumstances require.

The lower rear end of the chute R of each means D is fixed to the plate P by a pair of laterally spaced brackets 20 so that the lower edges 21 of the chute defining the lower open ends of the chute occur in limited spaced relationship above the top of the plate P. The brackets 20 serve to support the chute at its lower rear portion and at the same time afford limiting yielding pivoting of the chute relative to the plate P. The brackets 20 related to each chute are extremely simple, sheet-metal angle brackets with vertical legs fixed to the rear walls of the chute and have horizontal legs fixed to the plate P as by means of screw fasteners.

The forward end of the chute R of each means D is normally yieldingly urged and held up by a positioning means E. The means E is shown as including spaced related brackets 22 and 23 on the front wall 12 of the housing H and the front wall of the chute, adjacent its upper edge, a threaded post 24 projecting upwardly and rearwardly from the bracket 22 and through the bracket 23, a stop nut 25 on the post above the bracket 23 and a compression spring 26 about the post, between the brackets and normally yieldingly urging the forward portion of the chute upwardly and the bracket 23 into stopped engagement with the nut.

The positioning means E serves to yieldingly pivot its related chute R rearwardly about the axis afforded by the brackets 20 at its lower rear end or portion, whereby the horizontal transversely extending lower portion or lower front end 21' of the chute, is spaced above the plate P a distance substantially equal to the mean vertical thickness of the folded maps M related thereto and such that the maps can be advanced forwardly, below the chute, and through the space defined by said lower front edge 21' and the plate P.

By advancing the nut 25 of the means E on the post 24, the extent to which the chute is pivoted and the space between the edge 21' of the chute and the plate P can be adjusted to accommodate maps of different thickness.

The discharge opening 19 related to each means D occurs in the front wall 12 of the housing H, adjacent the top of the plate P and in forward spaced and aligned relationship with the opening defined by the lower forward edge 21' of the chute and the plate P, whereby a map advanced forwardly from within the chute is advanced through the opening 19 where it is convenient to be manually engaged and drawn out of or extracted from the machine by a purchaser thereof.

Each dispensing means D that I provide next includes ejector means F which operates to engage and urge the lowermost map M in the related chute R in the manner set forth above. The ejector means F for each dispensing means D is shown as including a flat, elongate, horizontal U-shaped slide 30 with a flat horizontal plate-like base portion 31 slidably supported on the top surface of the plate P of the housing H, below the lower end of the chute R, with its longitudinal axis extending fore and aft.

The plate-like base portion 31 of the slide 30 is greater in lateral extent than the chute R and is provided with flat, vertical, upwardly projecting slide flanges 32 which occur laterally outward of and establish sliding engagement with the exterior surfaces of the side walls of the chute and which serve to orient and guide the slide 30 relative to the chute.

In addition to the foregoing, the slide 30 is provided with a downwardly projecting vertical, flat, plate-like drive member 33 on its bottom surface, which member projects through an elongate guide slot 34 in the plate P. The member 33 terminates in the lower chamber Y of the housing H, below the plate A. The slot extends fore and aft, as clearly shown in the drawings.

It will be apparent that the U-shaped slide 30 freely embraces the lower end of its related chute and is maintained down in sliding engagement with the plate by the supply of maps M and is held in alignment with the chute and against displacement by the noted relationship of its flanges with the sides of the chute.

The means F next includes map gripping means G on the base portion 31 of the slide 30, which means is adapted to establish driving engagement between the slide and the lowermost map in the chute R, upon forward shifting of the slide relative to the chute, plate and supply of maps and to establish free sliding engagement with the lowermost map upon rearward shifting of the slide relative to the chute, plate and supply of maps.

The gripping means G includes a pair of thin, flat, horizontal, laterally spaced grippers 35 fixed to the forward portions of the top surface of the base portion 31 of the slide as by means of flush rivets 36. The grippers are established of thin spring metal stock and are provided with transversely extending, normally forwardly and upwardly turned, inclined flanges with serrated edges defining a plurality of laterally spaced forwardly and upwardly disposed pointed paper engaging teeth 37. The teeth 37 are formed and inclined so they will not, under normal circumstances and conditions, pierce, puncture and/or tear the layer of paper they engage, but rather, simply bite into and engage the bottom surface of the lowermost paper map and establish forward driving engagement between the slide and the map. A sufficient number of teeth are provided to assure the desired and necessary driving engagement between the slide and the lowermost map to effect ejection of the map from the chute R.

The flange portion and teeth of the grippers 35 are very thin and light and are such that they are normally biased flat, to occur in a substantially horizontal plane, by the supply of maps which rest upon them and on the slide 30.

It is important to note that the base portion 31 of the slide is coextensive with the lateral extent of the chute and in practice is of maximum longitudinal extent which spaced and required movement of the slide permits. In practice, the area of the base portion 31 of the slide is greater than $\frac{1}{2}$ and is preferably about $\frac{2}{3}$ the cross-sectional area of the chute and such that its top surface frictionally engages from $\frac{1}{2}$ to $\frac{2}{3}$ of the opposing bottom surface of the lowermost map in the chute, to support the map and carry it forward when the slide is moved forward.

The base portion 31 of the slide is of substantial thickness and has a straight transverse forward edge 33'. Since the base portion 31 of the slide occurs below and supports $\frac{1}{2}$ to $\frac{2}{3}$ of the lowermost map M, the slide supported portion of the map is supported on a plane above the top plane of the plate P and above the plane of that portion of the bottom surface of the map supported by the plate.

Figure 8:
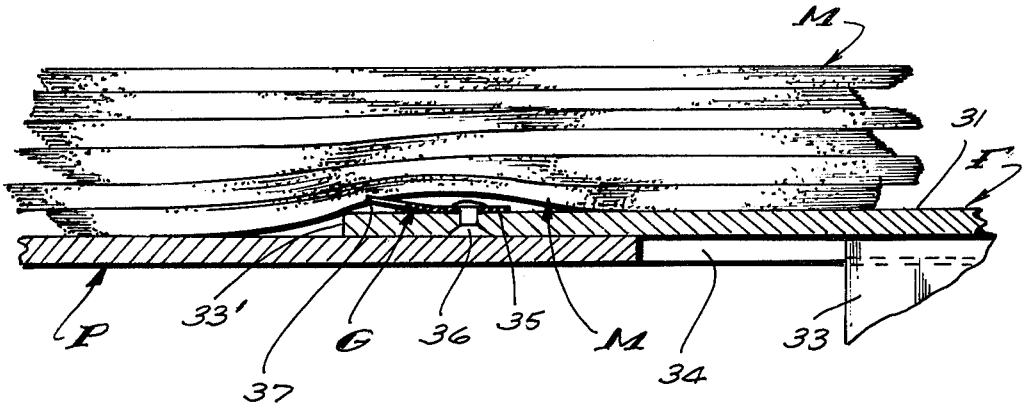
FIG. 8 is an enlarged detailed sectional view of a portion of the present invention.

As a result of the above, the portion of the lowermost map which overlies the front edge portion of the slide is engaged, urged and held up by the upper, forward corner edge of the slide established by the top surface of the base portion 31 and front edge 33' of the slide. When the slide is in its rearmost position, preparatory to being shifted forward, the above noted supporting relationship of the forward edge of the slide with the map M causes its upwardly slide supported portion immediately forward of the slide to turn upwardly and the portion of the map immediately rearward of the forward edge of the slide to bow rearwardly upwardly and thence downwardly in an arched condition over the forward portion of the slide, substantially as shown in FIG. 8 of the drawings.

When the mechanism is permitted to stand idle for a short period of time, the lowermost map settles and the above noted arched condition is reduced or eliminated. However, as soon as the slide is moved forwardly and the forward leading edge of the slide is advanced below and relative to the lowermost map, the noted arched condition is re-established and is in fact accentuated.

The above noted arching of the lowermost map is not an undesirable or incidental function in our invention but is a desired and sought after function, since it flexes and disposes the bottom surface of the lowermost map M adjacent the forward portion of the slide upwardly above the forward portion of the slide and the biased and flattened grippers 35 to unbias and permit the flange and/or teeth 37 of the grippers to establish their normal upwardly and forwardly disposed position and to establish gripping engagement with the bottom surface of the map, within the forward, upwardly and rearwardly inclined portion of the noted arched portion.

It is to be particularly noted that if the grippers were sufficiently stiff and strong so that they could not be biased flat by the weight of the supply of maps, they would be such that they would readily pierce and mutilate the maps. Further, since the grippers are such that they are biased flat by the supply of maps, if the lower surface of the lowermost map was not deformed and caused to arch in the manner described above and to unbias the grippers, the grippers, upon forward shifting of the slide, would simply slide beneath the lowermost map and could not establish gripping engagement with the map.

Attempts to place the gripping means on the rear portion of the slide and/or to make the gripping means more rigid or stiff have proven the foregoing to be true.

Finally, the means D includes an advancing weight W in the form of a substantially flat, horizontal metal plate 37 slidably engaged in the chute R and engaged on the top of the stack of maps M. The plate 37 or weight W advances and holds the stack of maps down in the chute with the lowermost map in flat pressure engagement with the base portion 31 of the slide 30 and with the grippers 35 of the means F. The weight W is provided with an upwardly and forwardly turned front portion to provide for convenient manual engagement of the weight and to facilitate its removal from within the chute R when a fresh supply of maps is to be engaged in the chute from the upper open end thereof. The transversely extending rearwardly disposed rear surface of the upwardly turned portion of the weight W and the front transversely extending edge of the weight W are adapted to establish free sliding engagement with the rear and front walls of the chute.

The actuating means A that I provide for each dispensing means D is preferably in the form of a standard coin-release slide actuator and includes, generally, a mounting means 40 securing it in a suitable related opening in the front wall 12 of the housing H, a carriage 41 supported by the mounting means 40 in fixed relationship with the said front wall 12 and an elongate, axially shiftable actuator bar 42 with a forward end portion 43 projecting from the carriage 41 and from the housing H and a rear portion 44 extending rearwardly from the carriage 41 and into the chamber Y beneath the plate P. The forward portion of the bar has a manually engageable tab 45 and a coin-receiving aperture 46. Suitable coin releasable latching means (not shown) is provided in and between the carriage 41 and the bar 42 and is such that only when a coin is engaged in the aperture 46 can the bar be manually urged axially rearwardly from a normal locked, forward position.

The actuator of the actuating means A can be one of numerous commercially available coin-released actuators of the general character referred to above and can vary widely in details of construction without affecting the present invention or departing from the spirit thereof.

The actuator of means A is arranged in the lower portion of the front wall 12 of the housing with its rear portion in the lower chamber Y. A coin tray (not shown) can be arranged in the chamber Y below the several actuators of the machine, to receive coins advanced therethrough. Such a tray can be made readily accessible through an access opening in the housing, such as the opening in the end of the housing which is normally closed by the aforementioned door 17.

The rear end portion of the bar 42 of each actuator A occurs in spaced relationship below the drive member 33 depending from the base portion 31 of its related slide 30. Each bar 42 carries an upwardly projecting U-shaped drive coupling 46 having a base fixed to the bar and having front and rear legs or posts which project upwardly from the base and which occur in driving juxtaposition with the front and rear sides or edges of the drive members 33, whereby the slides 30 are driven forwardly and rearwardly with the bars 42 when and as the bars are manually driven forwardly and rearwardly.

Figure 3:
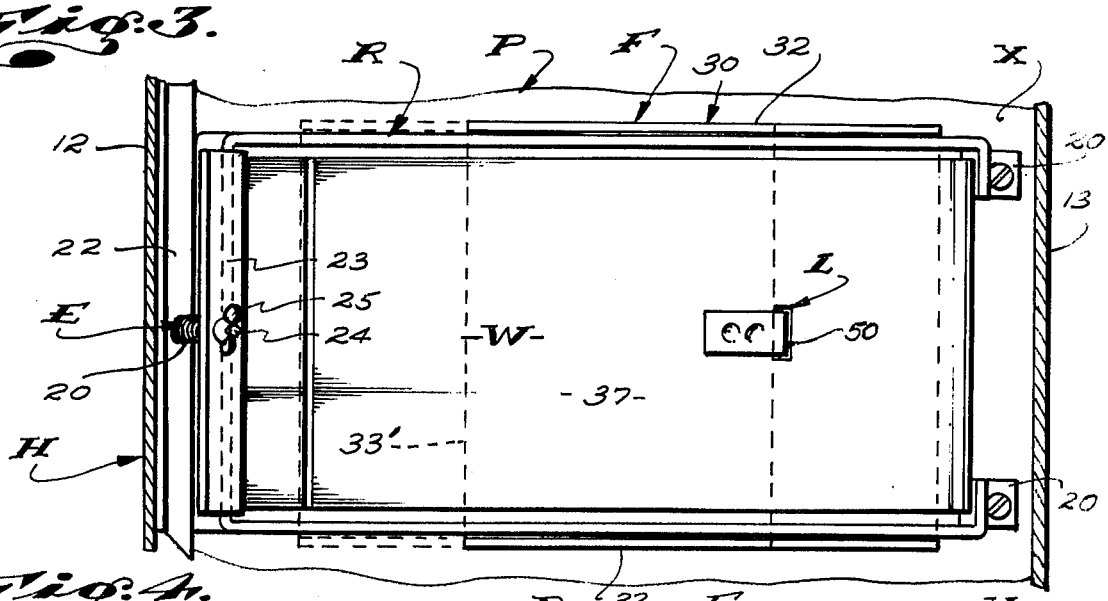
FIG. 3 is a view taken as indicated by line 3—3 on FIG. 2.
Figure 4:
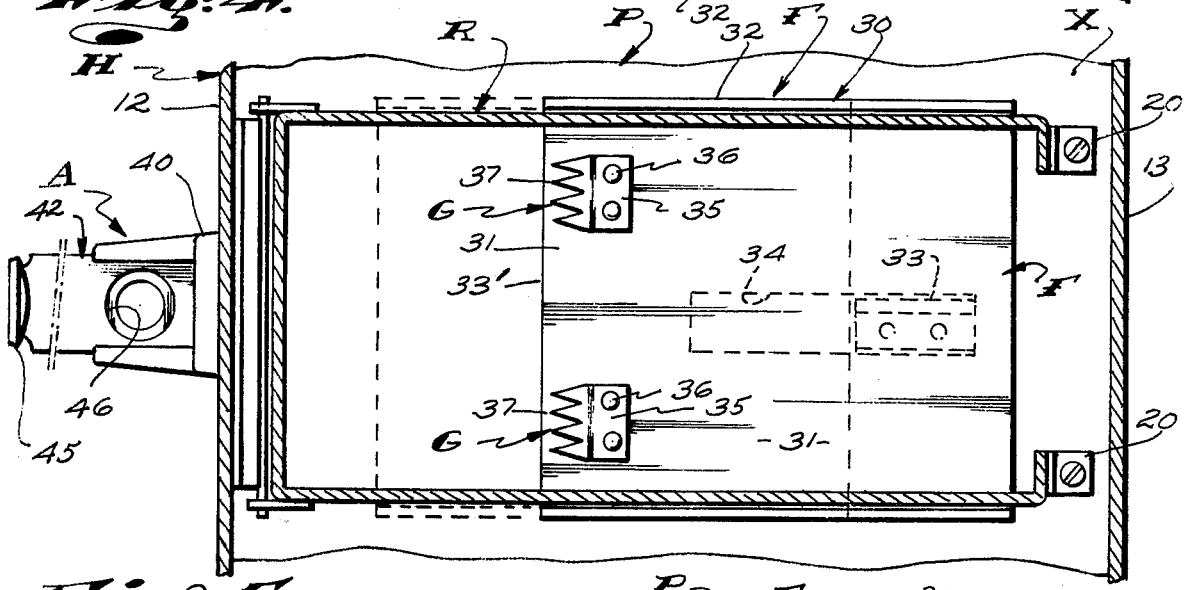
FIG. 4 is a view taken as indicated by line 4—4 on FIG. 2.
Figure 5:
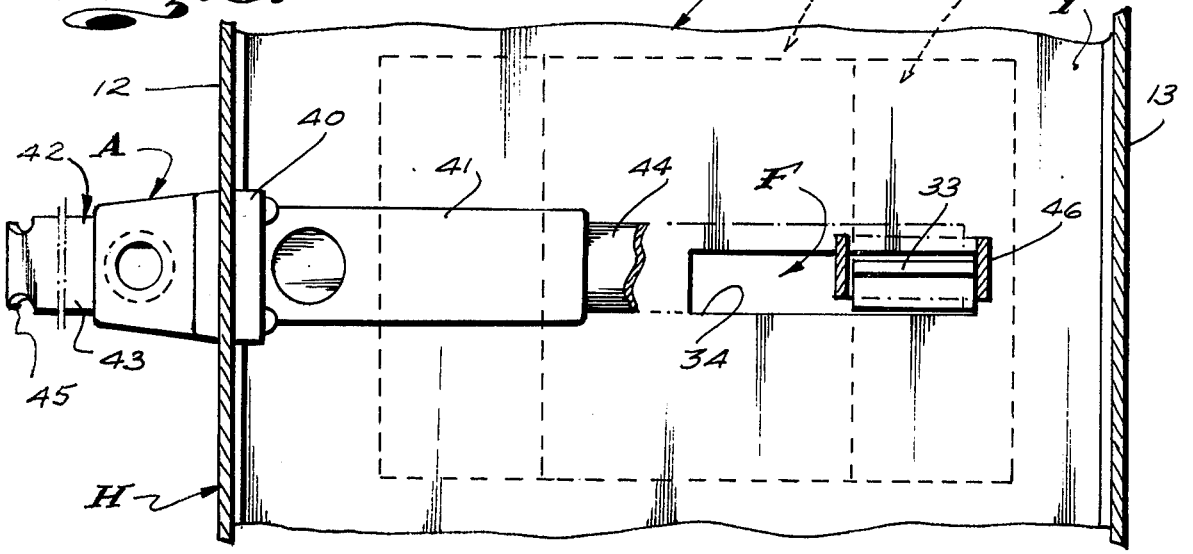
FIG. 5 is a view taken as indicated by line 5—5 on FIG. 2.
Figure 6:
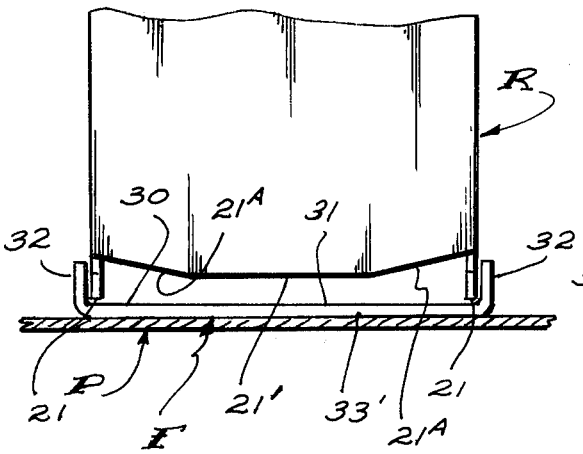
FIG. 6 is a view taken substantially as indicated by line 6—6 on FIG. 2.
Figure 7:
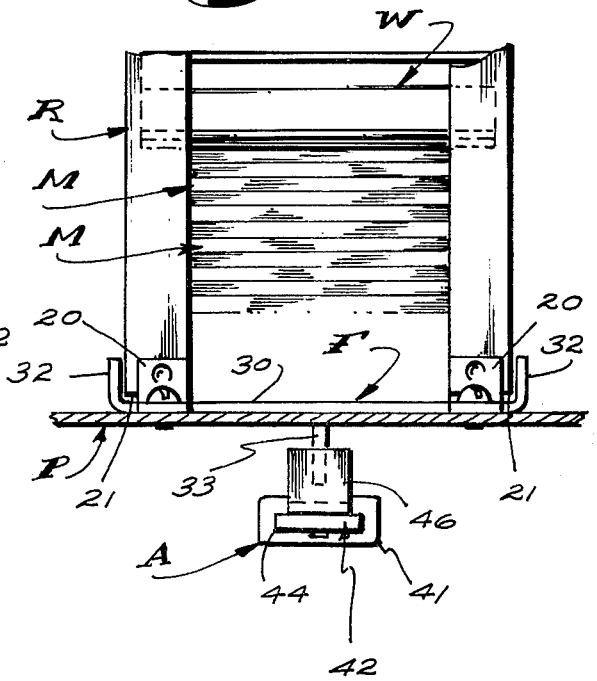
FIG. 7 is a view taken substantially as indicated by line 7—7 on FIG. 2.

In practice, the slide 30 and the bar 42 related to each means D normally occur in their forwardmost position relative to the lower end of their related chute, as indicated in dotted lines in FIGS. 3, 4 and 5 of the drawings. Upon depositing a coin in the means A, the bar 42 and slide 30 are first shifted rearwardly relative to the chute R to their rearmost or actuated position, as shown in full lines in the drawings and the slide 30 occurs under the rear portion of the lowermost map M related thereto. Thereafter, the bar and slide are moved forwardly or returned to their normal position, during which movement, the slide 30 with its mean G engages and advances the adjacent map forwardly and out through the opening 19 in the front wall of the housing H.

The aforementioned locking means L that I provide is operable to lock and effectively prevent operation of the means A when the supplies of maps related thereto are exhausted. The means L related to each means D is extremely simple and includes a stop member or post 50 of limited vertical extent depending from the bottom surface of the weight W and positioned to occur immediately forward of the rearmost edge of the base portion 31 of its related slide 30 when that slide is in its normal forward position and when the last of the supply of maps has been dispensed and the weight engages and rests on the slide 30, directly. So long as a map remains in the chute R, the weight is maintained spaced from the slide thereby and the stop member 50 is held out of engagement with the rear end of the slide. When the last map is dispensed, the weight engages the slide and the slide member is free to move into stopping engagement with the rear end of the slide. It will be apparent that with the means L that I provide the means D is effectively and positively locked against subsequent operation when the supply of maps related thereto is exhausted.

In the preferred carrying out of my invention and as shown in the drawings, the central portion of the laterally extending horizontal lower front edge 21 of the chute R of each means D is straight and horizontal and that the opposite end portions of that edge are inclined laterally and upwardly as at $21^A$ to relieve the opposite sides of the map conducting gap or space defined by the edge 21 and the plate P. That is, the edge 21' is relieved at its ends, as at $21^A$, so that the map conducting gap defined by that edge and the plate is enlarged and is at its opposite ends. The enlarging of the ends of the noted gap or relieving of the ends of the edge 21', while appearing extremely simple, is extremely important and constitutes a noted advance in the art since it greatly enhances the effectiveness and reliability of the dispensing means, as hereinafter described. The ordinary multipanel folded map is normally of predetermined thickness when in folded condition and is such that an opening or gap can be established and set in a vending machine to properly and effectively accommodate and permit the passage of the map. Not infrequently, however, as a result of any one of more of a multitude of factors which come into play, the edge portions of such maps, where the fold lines of adjacent panels occur, expand, with the result that the maps swell or are larger at their edges than they are throughout their flat central panel portions. When such maps swell or become enlarged at their edges, they frequently become jammed, dragged and/or are torn when engaged through a gap or space which is set with respect to their normal thickness and to slidably accommodate the maps. By relieving the end portions $21^4$ of the edge 21' of the chute R of each means D, with resulting enlargement of the portions of the gap defined thereby, the enlarged or swelled edges of an occasional map or of a series of maps are freely accommodated and the tendency for such maps to become jammed in, torn by, or otherwise adversely affect the handling and dispensing thereof, is eliminated.

While the forward edges of the maps also tend to become thicker than the central portions, such thickening is less extensive due to the shorter length of those edges. Furthermore, the forward or leading edges of the maps, when properly deposited in the chutes R, are defined by the outside or last fold of the maps, which folds define rather large radii which effectively guide and/or feed the front portions of the maps into and through the central narrow portions of the gaps defined by the central portions of the edges 21' and the plate.

In the preferred carrying out of this invention, a gate 60 is pivotally carried by the front wall of each chute R to occur forward of and depend from the edge 21'. The gate 60 is such that it will, in most instances, prevent the inserting of an instrument into the dispensing means of the machine which would be effective to extract or steal a map therefrom.

Further, in practice, it has been found to be desirable to provide a downwardly and forwardly inclined map guide 65 rearward and immediately above each discharge opening or slot 19 in the front wall of the housing H to guide and assure proper movement of maps advanced from the means D, into and through the openings 19.

Having described one preferred form and embodiment of my invention, we do not wish to be limited to the specific details herein set forth, but wish to reserve to myself any modifications and/or variations which may appear to those skilled in the art and which fall within the scope of the following claims:

Having described my invention, I claim:

1. A vending machine to retain a stacked supply of flat, horizontal, rectangular multi-paneled folded paper road maps and operable to dispense maps from the stacked supply, one at a time, said machine comprising an elongate vertical box-like housing with top, bottom, front, rear and side walls, a flat, horizontal plate with top and bottom surfaces in the housing in spaced relationship above the bottom wall, a discharge opening in the front wall adjacent the top surface of the plate, an elongate vertical chute corresponding generally in cross-section with the plane configuration of a related folded paper map and slidably receiving a vertical stack of maps, said chute having front and side walls defining lower front and side edges on the chute, means mounting the chute on the plate with its bottom edges in spaced relationship above the top surface, said front edge and top surface defining a map discharge gap in substantial alignment with the discharge opening, an elongate U-shape slide with a flat, horizontal base slidably supported on said top surface and extending transverse the chute and vertical side flanges at the exterior of and slidably engaging the side walls of the chute, said base transportingly supporting a portion of the lowermost map of said stack of maps, gripping means on the base establishing driving engagement with the lowermost map upon forward shifting of the slide relative to the chute, and operating means including a manually operable coin-released actuator with a forwardly and rearwardly shiftable bar carried by and extending through the front panel below the plate, an elongate forwardly and rearwardly extending slot in the plate below the slide, a vertical drive post on the slide depending freely through the slot and below the plate and a drive coupling between the bar and the post.

2. The vending machine set forth in claim 1 wherein said means mounting the chute includes resilient vertical mounting brackets fixed to and extending between the rear portion of the chute and the plate, spring means between the front panel and the front wall yieldingly urging the upper end of the chute rearwardly and the lower forward edge of the chute upwardly relative to the plate and screw means between the front panel and front wall limiting movement of the chute by action of said spring means whereby the gap defined by said front edge and plate can be adjusted to slidably accommodate maps of predetermined thickness, one at a time.

3. The vending machine set forth in claim 2 wherein said lower front edge of the chute has a central horizontal portion and upwardly and laterally outwardly inclined opposite end portions whereby the gap defined by that edge and the plate is of minimum vertical extent to accommodate the central panel portions of related maps and is of greater vertical extent at its opposite end portions to freely accommodate the sides of related maps which are expanded by folds between adjacent panels of the maps and which occur at the sides of the said maps.

4. The vending machine set forth in claim 1 wherein said lower front edge of the chute has a central horizontal portion and upwardly and laterally outwardly inclined opposite end portions whereby the gap defined by that edge and the plate is of minimum vertical extent to accommodate the central panel portions of related maps and is of greater vertical extent at its opposite end portions to freely accommodate the sides of related maps which are expanded by folds between adjacent panels of the maps and which occur at the sides of the said maps.

5. The machines set forth in claim 1 which further includes an advancing weight with a flat bottom slidably engaged in the chute and normally engaged on top of the stack of maps, said weight being engageable on the top of the slide base when the last map is dispensed and stop means to prevent operation of the machine when the last map has been dispensed including a rearwardly disposed edge of the slide base and a stop shoulder depending from the bottom of said weight and establishing stopped engagement with said rearwardly disposed edge when the slide is shifted forwardly relative to the chute and the weight is engaged on the slide.

6. The vending machine set forth in claim 5 wherein said means mounting the chute includes resilient vertical mounting brackets fixed to and extending between the rear portion of the chute and the plate, spring means between the front panel and the front wall yieldingly urging the upper end of the chute rearwardly and the lower forward edge of the chute upwardly relative to the plate and screw means between the front panel and front wall limiting movement of the chute by action of said spring means whereby the gap defined by said front edge and plate can be adjusted to slidably accommodate maps of predetermined thickness, one at a time.

7. The vending machine set forth in claim 6 wherein said lower front edge of the chute has a central horizontal portion and upwardly and laterally outwardly inclined opposite end portions whereby the gap defined by that edge and the plate is of minumum vertical extent to accommodate the central panel portions of related maps and is of greater vertical extent at its opposite end portions to freely accommodate the sides of related maps which are expanded by folds between adjacent panels of the maps and which occur at the sides of the said maps.

8. The vending machine set forth in claim 5 wherein said lower front edge of the chute has a central horizontal portion and upwardly and laterally outwardly inclined opposite end portions whereby the gap defined by that edge and the plate is of minimum vertical extent to accommodate the central panel portions of related maps and is of greater vertical extent at its opposite end portions to freely accommodate the sides of related maps which are expanded by folds between adjacent panels of the maps and which occur at the sides of the said maps.

9. The vending machine set forth in claim 1 wherein said base has a transverse forward edge, the bottom surface of the portion of said lowermost map forward of the said forward edge of the base extending downwardly and forward to said plate, the bottom surface of the portion of said lowermost map rearward of said forward edge of the base being arched rearwardly upwardly and thence rearwardly downwardly above the forward portion of the base when said base is moved forwardly, said gripping means including resilient grippers with laterally spaced normally forwardly and upwardly inclined forwardly convergent map surface engaging teeth fixed to the forward portion of the base and positioned with the arched portion of the lowermost map with said teeth in map surface gripping angular relationship with the rearwardly and upwardly extending portion of said arch in said map.

10. The vending machine set forth in claim 9 wherein said lower front edge of the chute has a central horizontal portion and upwardly and laterally outwardly inclined opposite end portions whereby the gap defined by that edge and the plate is of minimum vertical extent to accommodate the central panel portions of related maps and is of greater vertical extent at its opposite end portions to freely accommodate the sides of related maps which are expanded by folds between adjacent panels of the maps and which occur at the sides of the said maps.

11. The machine set forth in claim 9 which further includes an advancing weight with a flat bottom slidably engaged in the chute and normally engaged on top of the stack of maps, said weight being engageable on the top of the slide base when the last map is dispensed and stop means to prevent operation of the machine when the last map has been dispensed including a rearwardly disposed edge on the slide base and a stop shoulder depending from the bottom of said weight and establishing stopped engagement with said rearwardly disposed edge when the slide is shifted forwardly relative to the chute and the weight is engaged on the slide.

12. The vending machine set forth in claim 9 wherein said means mounting the chute includes resilient vertical mounting brackets fixed to and extending between the rear portion of the chute and the plate, spring means between the front panel and the front wall yieldingly urging the upper end of the chute rearwardly and the lower forward edge of the chute upwardly relative to the plate and screw means between the front panel and front wall limiting movement of the chute by action of said spring means whereby the gap defined by said front edge and plate can be adjusted to slidably accommodate maps of predetermined thickness, one at a time.

* * * * *